United States Patent [101]

Cullinan et al.

[11] 4,052,880

[45] Oct. 11, 1977

[54] PIPE PERFORATING MACHINE

[75] Inventors: Robert L. Cullinan; Ronald W. Jay; Keith Beck; Lloyd J. Miller, all of Paxton, Nebr.

[73] Assignee: Noah E. Foulks, Dodge City, Kans.

[21] Appl. No.: 713,240

[22] Filed: Aug. 10, 1976

[51] Int. Cl.[2] ..... B21D 28/10; B21D 28/28

[52] U.S. Cl. ..... 72/326; 72/370; 29/163.5 F

[58] Field of Search ..... 72/325, 326, 332, 367, 72/370, 186, 113, 204, 203, 71; 29/163.5 R, 163.5 F; 113/116 A, 116 UT; 83/54, 187, 188, 191

[56] References Cited

U.S. PATENT DOCUMENTS

| | | | |
|---|---|---|---|
| 750,746 | 1/1904 | Woodburn | 83/191 |
| 1,054,143 | 2/1913 | Plost | 83/187 X |
| 1,432,073 | 10/1922 | Lowy | 72/325 |
| 2,696,254 | 12/1954 | Mugavero | 83/187 X |
| 3,022,811 | 2/1962 | Huet | 72/325 |
| 3,259,003 | 7/1966 | Griffin | 83/191 X |
| 3,540,258 | 11/1970 | Branson | 83/54 X |
| 3,678,718 | 7/1972 | Brown et al. | 72/71 |
| 3,782,157 | 1/1974 | Foulks et al. | 72/71 |
| 3,815,399 | 6/1974 | Foulks et al. | 72/186 |

FOREIGN PATENT DOCUMENTS

| | | | |
|---|---|---|---|
| 759,768 | 10/1956 | United Kingdom | 83/191 |

*Primary Examiner*—Lowell A. Larson
*Attorney, Agent, or Firm*—John A. Hamilton

[57] ABSTRACT

A pipe perforating machine consisting of an arbor beam over which the pipe to be perforated is moved axially, the beam carrying at its free end a radially extendable die which when extended cooperates with an external die to punch a perforation in the pipe wall, and automatic control mechanism operable once energized to move the pipe axially so that a row of perforations are formed therein, return it to its starting position, index it angularly relative to the dies, advance the pipe to punch another row of perforations, repeating the process until the desired number of rows of perforations have been punched, and finally return the pipe to its starting position, where it may easily be removed and replaced with another pipe, and shut the machine off.

12 Claims, 13 Drawing Figures

PIPE PERFORATING MACHINE

This invention relates to new and useful improvements in pipe perforating machines, and has particular reference to pipe perforating machines which are essentially hydraulically powered. The use of perforated pipe, particularly for use as casing pipe in water wells in irrigation areas, has become very widespread, and there is a definite need for a machine which will accomplish the perforation rapidly, efficiently, and economically. The provision of such a perforating machine is the overall object of the present invention.

Specifically, an object of the present invention is the provision of a perforating machine including a cantilevered arbor beam over which the pipe to be perforated is axially introduced and advanced in steps, a hydraulically operated punch carried at the free end of the arbor beam, being operable in cooperation with a matching die external to the pipe to form a perforation in the pipe wall at each movement station of the pipe. A longitudinal row of perforations are thus formed in the pipe. The pipe may then be returned to its starting position, turned angularly to align another segment of the pipe with the dies, and again advanced for the formation of another row of perforation, the process being repeated until the pipe wall has been perforated to the desired density.

Another object is the provision of a perforating machine of the character described wherein each perforation is accomplished by relative movement of the cooperating dies radially to the pipe, and with the addition of a hydraulically operable pipe support for engaging the pipe at a point diametrically opposite from the dies, and operable to support the arbor beam against the reactive force of the beam-mounted die, since the beam is necessarily of substantial length and cannot practically be made sufficiently strong to remain rigid and fixed under the full die load.

A further object is the provision of a perforating machine of the general character described including a control system whereby the entire operation of perforating a pipe, including the punch and retraction strokes of the dies, the advance and return movements of the pipe, and the angular indexing of the pipe, is accomplished automatically without attention by the operator, the machine being brought to rest when perforation of the pipe is completed.

Other objects are relative simplicity and economy of construction, and efficiency, dependability and speed of operation.

Figure 1:
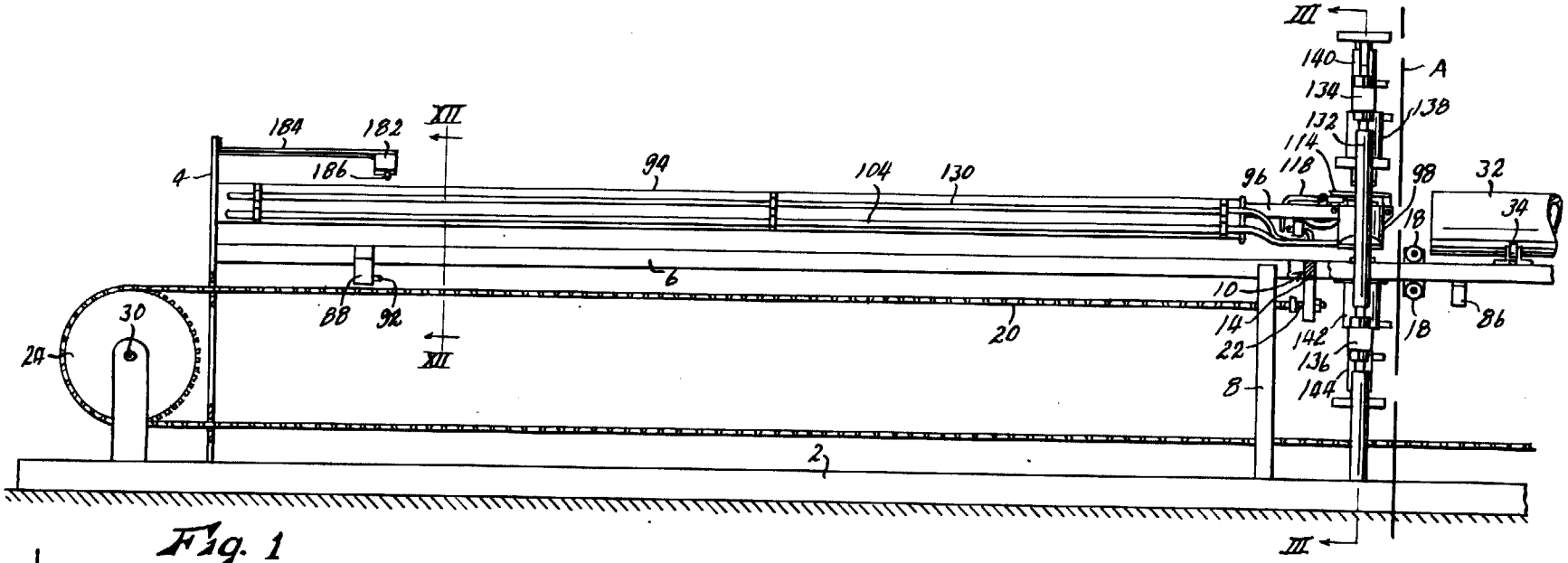
Figure 2:
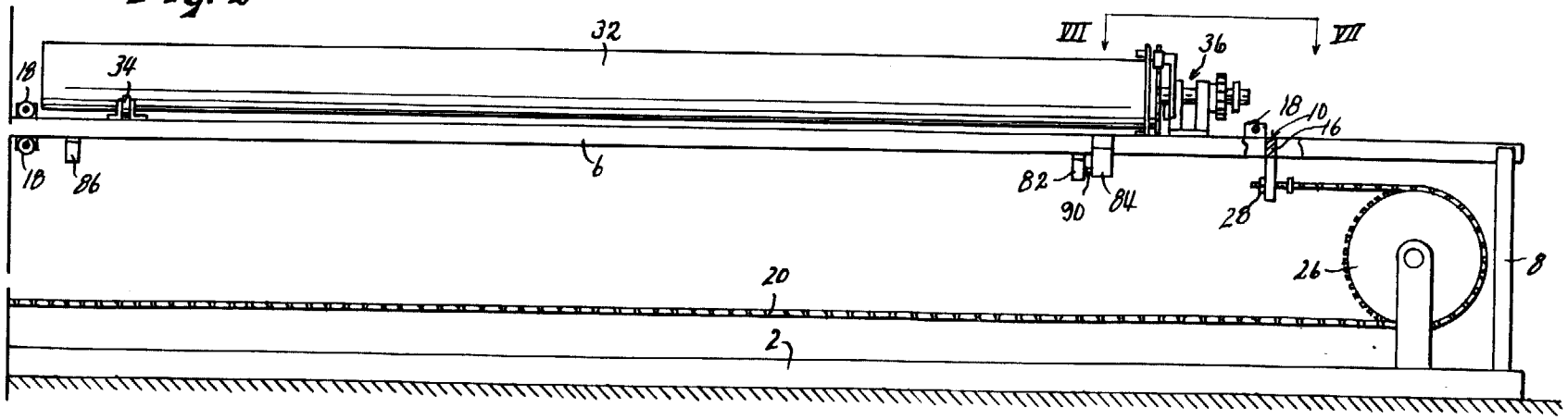
Figure 3:
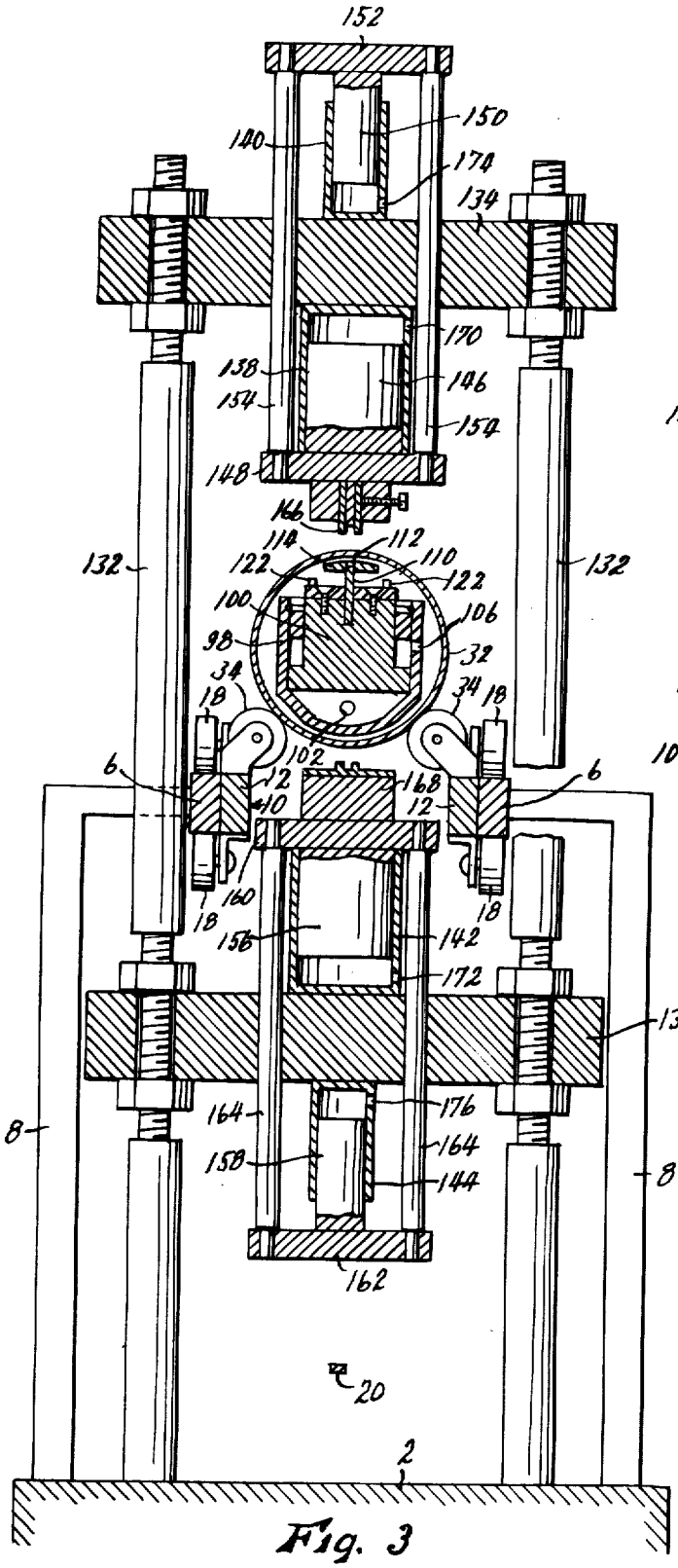
Figure 4:
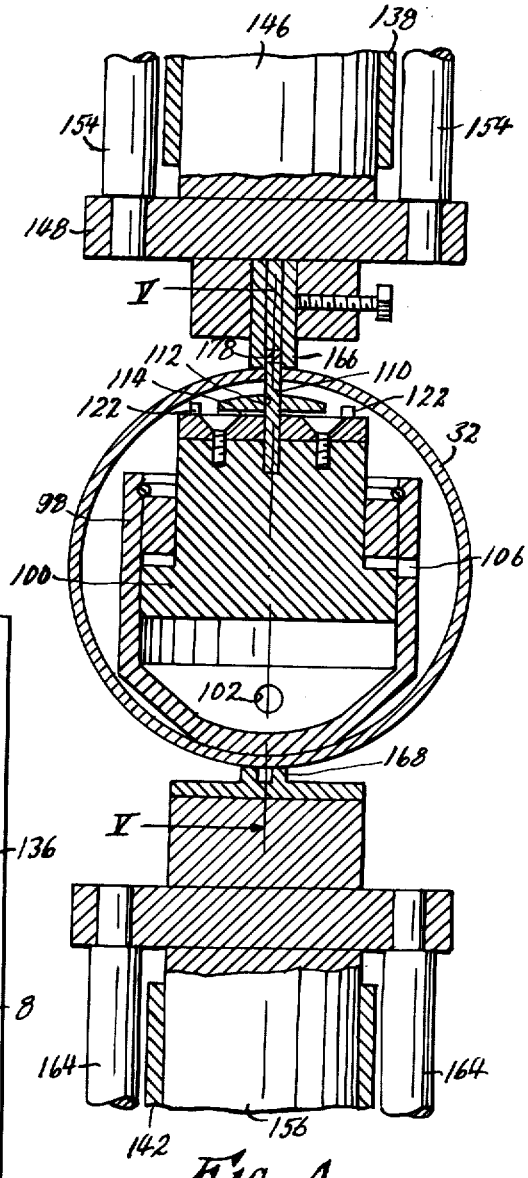
Figure 5:
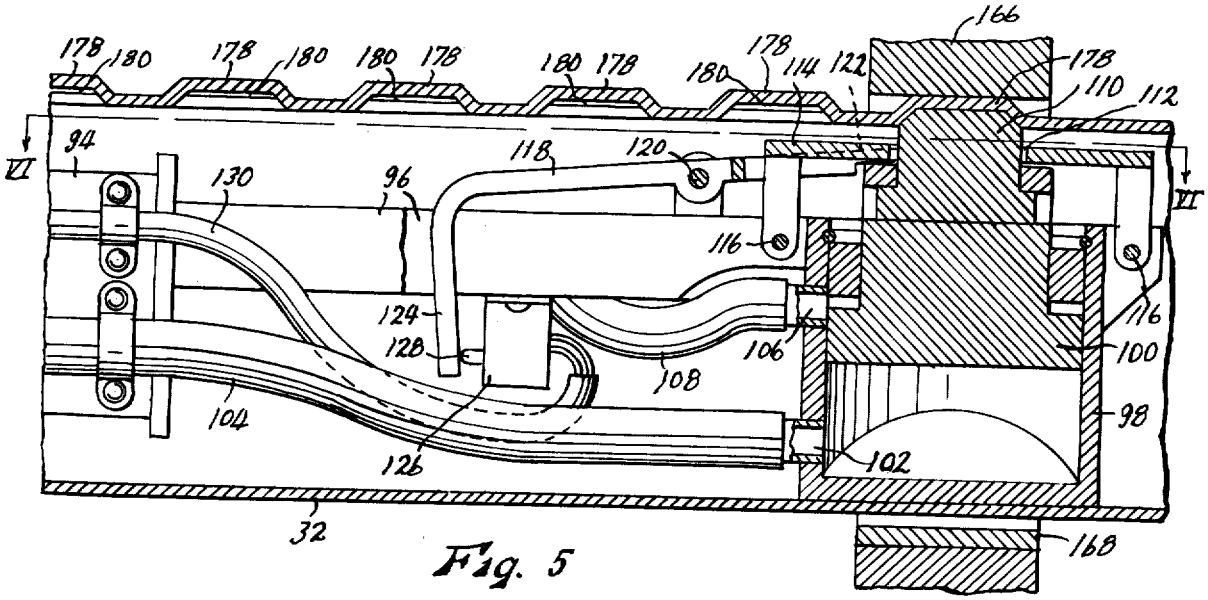
Figure 6:
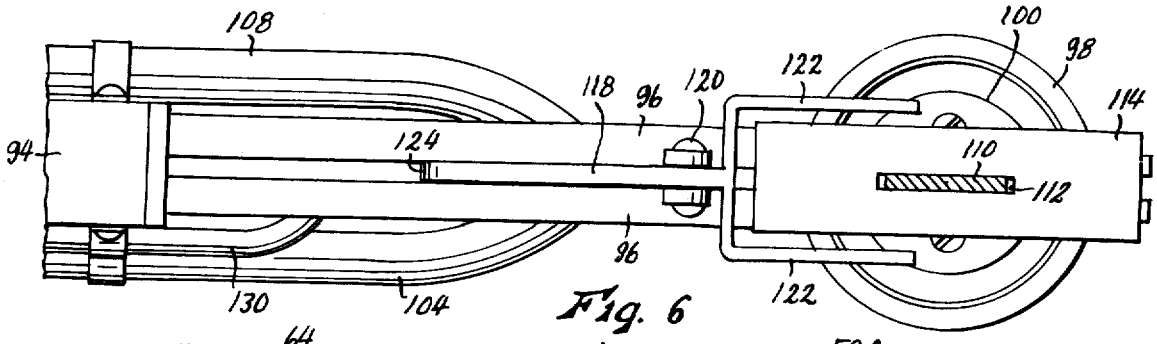
Figure 8:
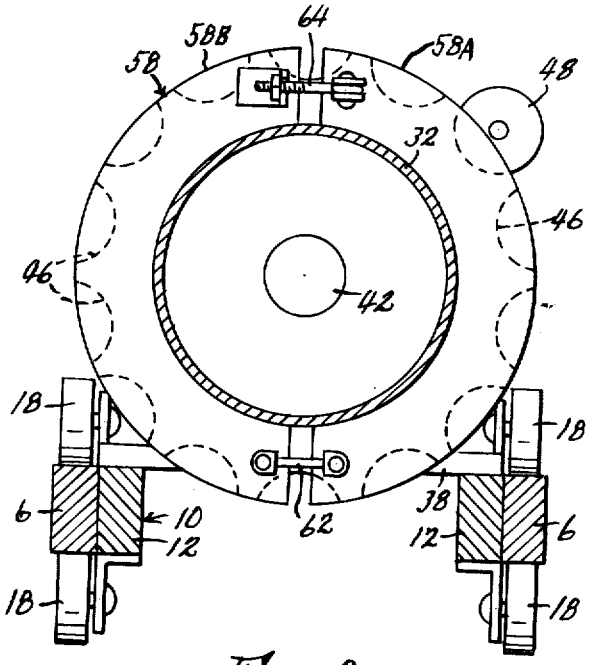
Figure 9:
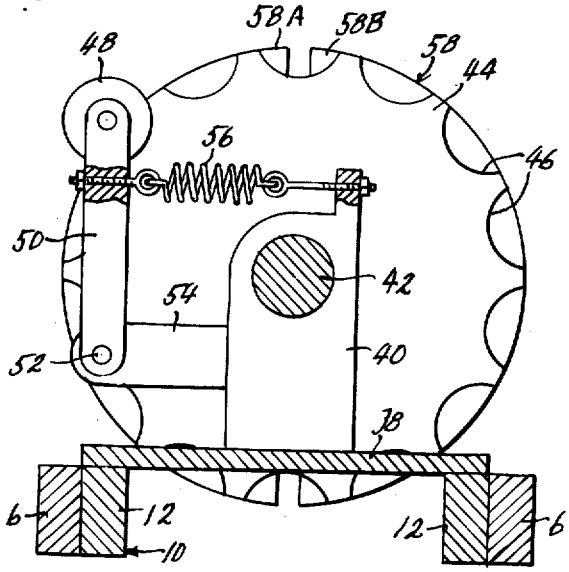
Figure 7:
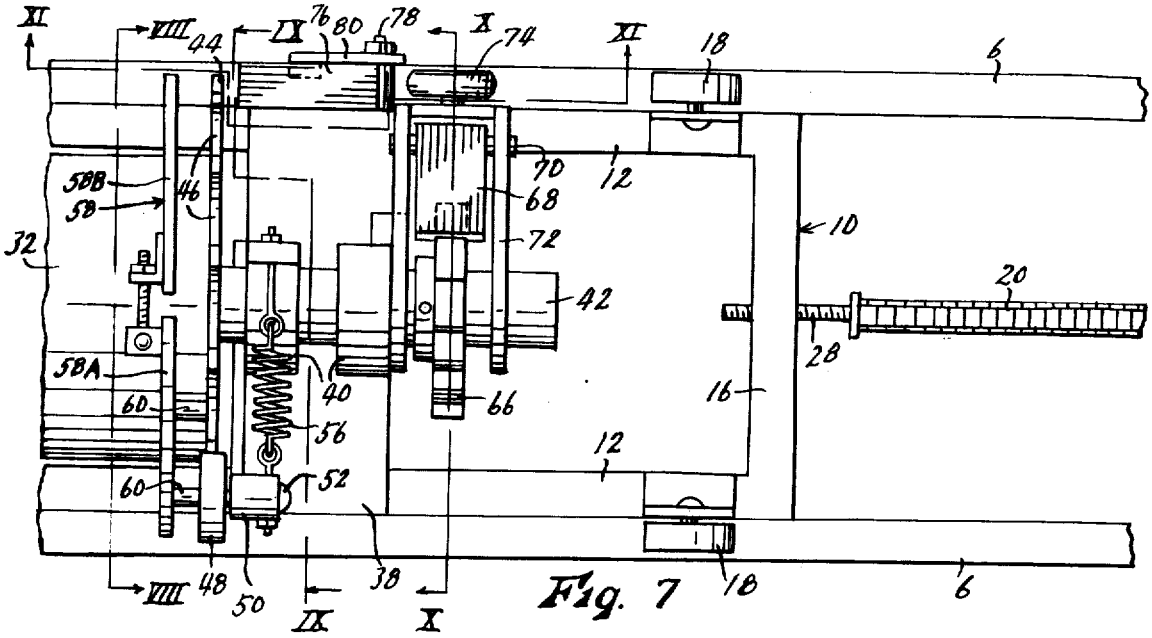
Figure 10:
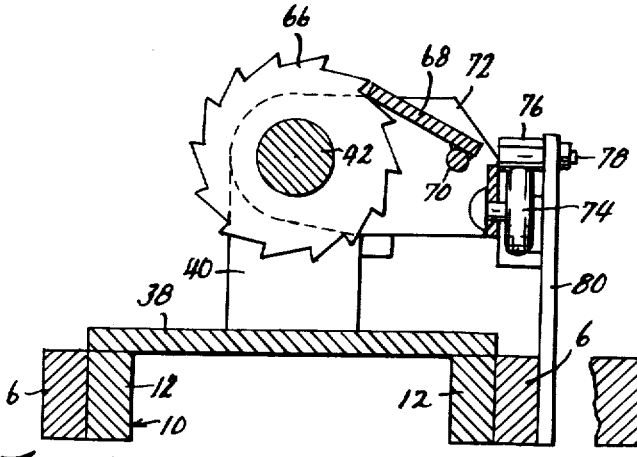
Figure 11:
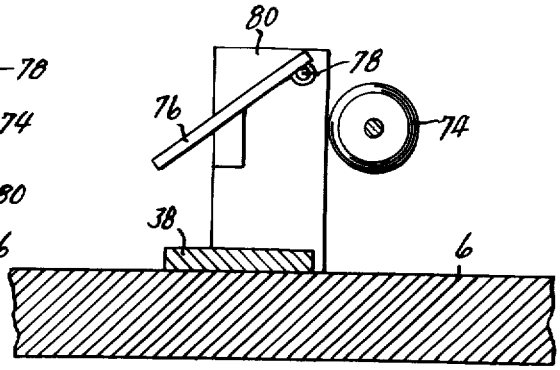
Figure 12:
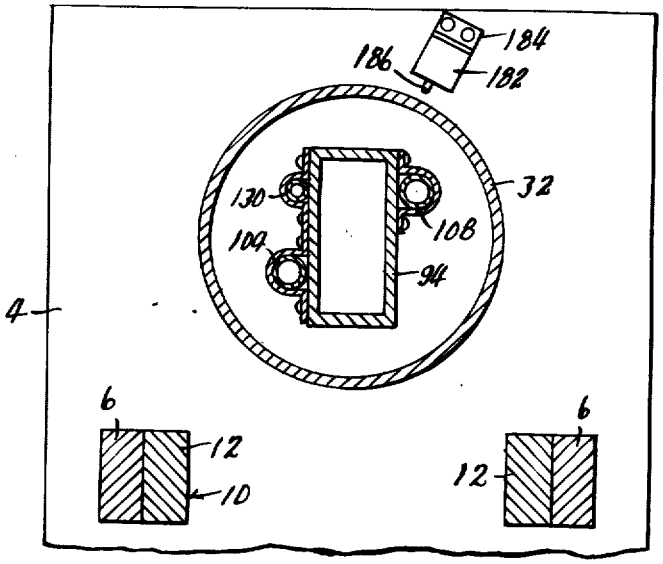
Figure 13:
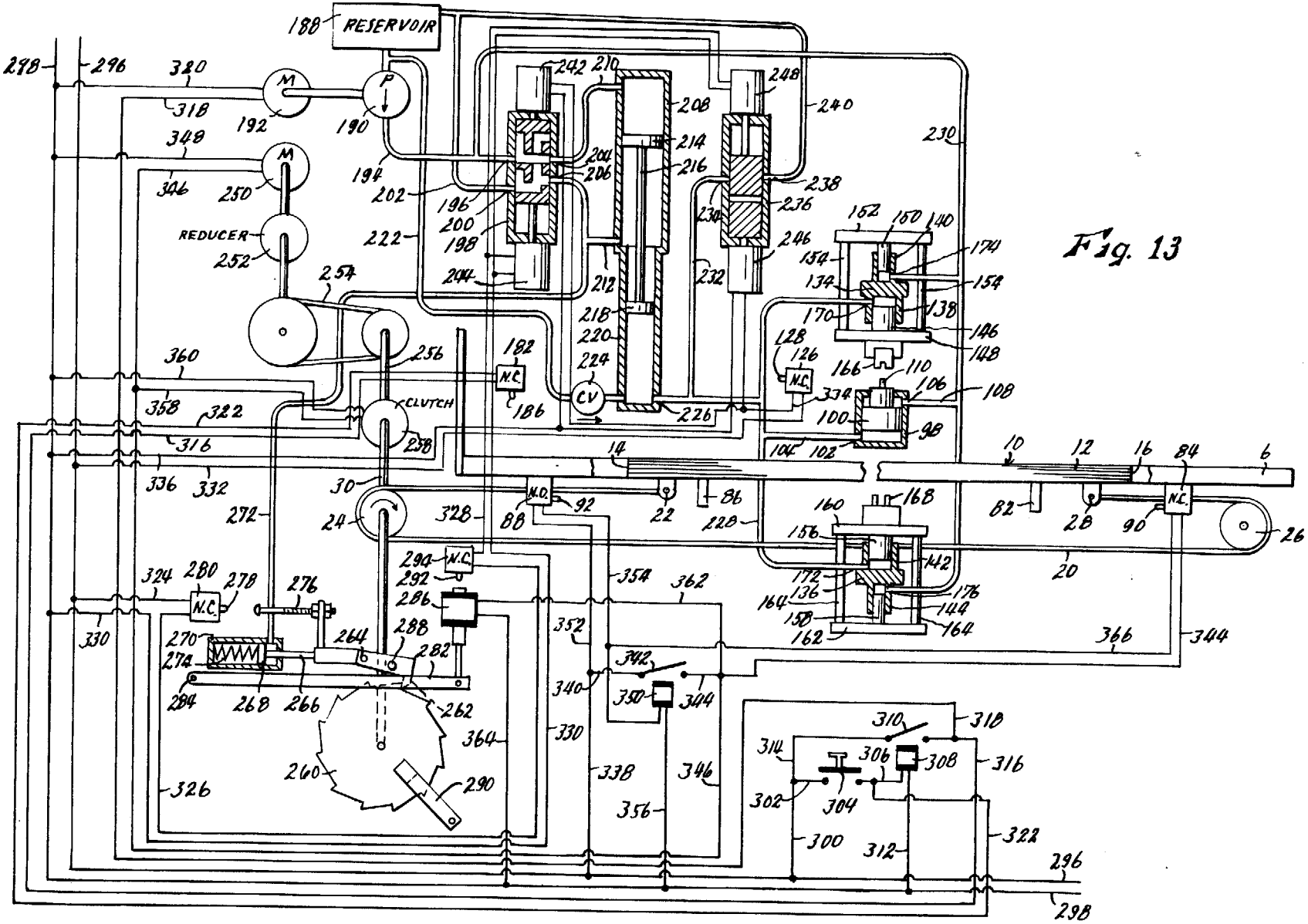

With these objects in view, as well as other objects which will appear in the course of the specification, reference will be had to the accompanying drawing, wherein:

FIG. 1 is a partially schematic side elevational view of the left or forward end portion of a pipe perforating machine embodying the present invention, FIG. 2 is a continuation to the right of FIG. 1, being a side elevational view of the right or rearward end portion of the machine, including those elements to the right of vertical line A of FIG. 1, and showing a pipe operatively mounted in said machine, FIG. 3 is an enlarged, partially schematic sectional view taken on line III—III of FIG. 1, with parts left in elevation and partially broken away, with the pipe advanced between the dies and the dies retracted, FIG. 4 is an enlarged, fragmentary view similar to FIG. 3, with parts omitted, and with the dies extended to form a perforation, FIG. 5 is a fragmentary sectional view taken on line V—V of FIG. 4, FIG. 6 is a sectional view taken on line VI—VI of FIG. 5, with the pipe omitted, FIG. 7 is an enlarged, fragmentary top plan view of the machine, as indicated by line VII—VII of FIG. 2, showing the pipe mounting and indexing head, FIG. 8 is a sectional view taken on line VIII—VIII of FIG. 7, FIG. 9 is a sectional view taken on line IX—IX of FIG. 7, FIG. 10 is a sectional view taken on line X—X of FIG. 7, FIG. 11 is a fragmentary sectional view taken on line XI—XI of FIG. 7, FIG. 12 is a fragmentary, enlarged sectional view taken on line XII—XII of FIG. 1, including the pipe, and FIG. 13 is a schematic diagram of the hydraulic and electric control system of the machine.

Like reference numerals apply to similar parts throughout the several views, and the numeral 2 applies to a suitable floor-supported base, said base being horizontally elongated and having mounted rigidly thereon a head plate 4, said head plate being vertical, disposed adjacent the left or forward end of the base, and facing toward the right or rearward end of the base. A pair of horizontal, parallel tracks 6 extend longitudinally of base 2 in spaced relation thereabove, being fixed at their forward ends to head plate 4 and extending substantially the full length of the base, and being supported at intervals along their length by base-supported legs 8. Base 2, head plate 4, tracks 6, legs 8, and posts 132 to be described, constitute the "frame" of the machine.

Movably supported on tracks 6 is a carriage 10 consisting of a pair of side rails 12 connected at their front ends by cross bar 14 (see FIG. 1), and at their rearward ends by cross bar 16 (see FIGS. 2 and 7). The carriage is substantially shorter than tracks 6, with its side rails 12 being inside of said tracks, and is supported for movement along said tracks by a pair of rollers 18 carried thereby adjacent each corner thereof, the rollers or each pair having rolling engagement respectively with the upper and lower surfaces of the associated track 6. A sprocket chain 20 is affixed at one end to front carriage cross bar 14, as at 22, extends forwardly and is trained downwardly around a sprocket wheel 24 carried rotatably by base 2 forwardly of head plate 4, then extends forwardly substantially the full length of the base, trained upwardly around a second sprocket wheel 26 also carried rotatably by base 2, then extends forwardly and is connected to rear carriage cross bar 16, as at 28. Thus by turning shaft 30 of sprocket 24, said shaft being horizontal and transverse to the direction of carriage travel, carriage 10 may be moved forwardly or rearwardly along the tracks. Shaft 30 is operated by a control system to be described.

Carriage 10 is adapted to support a pipe 32 to be perforated, in parallel, spaced apart relation above the midline thereof. Adjacent its forward end, said pipe is supported for axial rotation by a pair of rollers 34 mounted on the carriage adjacent its forward end, as best shown in FIGS. 1 - 3, and at its rearward end by an indexing head mounted on the carriage adjacent its rearward end, and designated generally by the numeral 36. As best shown in FIGS. 7 - 11, said indexing head includes a base plate 38 fixed to the carriage, and on which are fixed a pair of bearings 40 in which is journalled a shaft 42 which is coaxial with pipe 32. Fixed coaxially to the forward end of said shaft is a circular index plate 44 having a series of rounded notches 46 formed in the periphery thereof, said notches being regularly spaced angularly of the plate and corresponding in number to the desired number of longitudinal rows of perforations to be formed in the pipe. Adapted to engage in one of said notches, to secure the index plate yieldably against rotation, is a roller 48 mounted rotatably at one end of an arm 50, the opposite end of said arm being pivoted at 52 to a member 54 fixed to one of bearings 40. Roller 48 is biased yieldably into engagement with the periphery of the index plate by a tension spring 56 extending between arm 50 and one of bearings 40. Spaced forwardly of index plate 44 is a clamp ring 58 the plane of which is parallel to the plane of the index plate, and which is divided diametrically into two sections 58A and 58B. Section 58A is rigidly affixed to the index plate as by posts 60 (see FIG. 7). One pair of corresponding ends of the clamp ring sections are joined by a link 62 pivoted at at least one end, and the other pair of corresponding ends are detachably connected by a releasable clamp bolt 64, both as shown in FIG. 8. Thus by releasing bolt 64, the clamp ring may be opened to receive the rearward end of pipe 32, with the pipe end abutting the index plate, and the clamp ring may be closed to grip the pipe firmly by reengaging and tightening said bolt. Thereafter the pipe, supported adjacent its forward end by rollers 34 and at its rearward end by clamp ring 58, will be turned rotatably about its axis whenever shaft 42 is turned.

Shaft 42 is turned by a ratchet and pawl device including a ratchet wheel 66 fixed on said shaft and engaged by a pawl 68 pivoted at 70, on an axis parallel to the shaft, to a U-shaped bracket 72 pivoted at its opened end on shaft 42, said bracket carrying at its extended closed end a crowned roller 74 which is rotatable on an axis transverse to shaft 42, and which is disposed above one of tracks 6. As the carriage approaches the rearward end of its travel, roller 74 engages an upwardly and rearwardly inclined ramp 76 the upper end of which is pivoted on a horizontal transverse axis, as at 78, to a post 80 affixed to the associated track 6, and drops behind said ramp as the carriage completes its rearward travel. As it is cammed upwardly by said ramp, roller 74 causes bracket 72 to pivot on shaft 42, and causes pawl 68 to turn ratchet 66 and shaft 42, causing index plate 44 to turn, camming roller 48 out of engagement with a notch 46 of said index plate against spring 56, until roller 48 is generally aligned with the next of notches 46. As roller 74 drops behind ramp 76, pawl 68 is retracted along ratchet 66, and the index plate 44 is held accurately in the desired position of angular index by the firm engagement of roller 48 in said next index plate notch. As the carriage moves forwardly, as will be described, roller 74 pivots ramp 76 upwardly and passes thereunder without effect.

As the carriage completes its rearward travel, an operator finger 82 affixed thereto engages and opens a normally closed electric limit switch 84 affixed to one of tracks 6, and when said carriage reaches the forward end of its travel, an operator finger 86 affixed thereto engages and closes a normally open electric limit switch 88 mounted on one of tracks 6. Switches 84 and 88 form elements of the control system to be described. It will be understood that normally closed switch 84 is opened only so long as its operating button 90 is depressed by finger 82, and that normally open switch 88 is closed only so long as its operating button 92 is depressed by finger 86.

An arbor beam 94, coaxial with pipe 32 and of small enough cross-sectional size to enter said pipe, is affixed at its forward end to head plate 4, is supported thereby, and extends rearwardly therefrom for a distance somewhat greater than the length of said pipe. Referring principally to FIGS. 3 – 6, it will be seen that a pair of short longitudinally extending bars 96 are affixed to the free end of the arbor beam. Said bars ar horizontally spaced apart, and a hydraulic cylinder housing 98 is affixed to the forward ends of said bars. Carried for vertical movement in said cylinder is a double-acting piston 100 operable to be forced upwardly when hydraulic fluid is supplied to lower port 102 thereby by conduit 104, and to be forced downwardly when hydraulic fluid is supplied to upper port 106 thereof by conduit 108. The piston extends upwardly from the cylinder, and has a male die tooth 110 fixed in its upper end by any suitable means. Said die tooth is operable upward movement of the piston to punch a perforation in the wall of pipe 32, as will appear. Tooth 110 projects slidably through a slot 112 formed therefor in a horizontal stripper plate 114 bridging the top of the piston and rigidly secured to cylinder housing 98 as by blots 116 (see FIG. 5). A switch operating arm 118 is pivoted intermediate its ends, as at 120, to bars 96, just forwardly of cylinder 98. The rearward end portion of arm 118 is divided to form a pair of fingers 122 which rest against the top of piston 100, respectively at laterally opposite sides of die tooth 110, and the forward end portion of arm 118 is angled downwardly between bars 96 to form a switch operating finger 124. When piston 100 is fully elevated, signalling that tooth 110 has completed a perforation in the pipe wall, it engages fingers 122 of arm 118 and pivots said arm to cause finger 124 to engage and open a normally closed electric switch 126 which is mounted on bars 96 forwardly of cylinder 98. Said switch remains open only so long as its control button 128 is depressed by finger 124, and is an element of the control system to be described. When die tooth 110 is retracted downwardly, the entire assembly carried by arbor beam 94 is of sufficiently small lateral dimensions that pipe 32 may be advanced axially thereover, as indicated in FIG. 3. Hydraulic conduits 104 and 108, as well as an electrical conduit 130 for the electrical leads to switch 126, extend forwardly along arbor beam 94 to head plate 4, and are attached thereto at intervals by any suitable means.

Dies and support means cooperating with die tooth 110 are carried externally of pipe 32 by a pair of strong posts 132 fixed at their lower ends in base 2 and extending upwardly above tracks 6 at respectively oppositely sides of the tracks, and in accurate lateral alignment with the axis of cylinder 98. A pair of strong cross-heads 134 and 136 extend horizontally between posts 132 and are rigidly supported thereby, respectively above and below tracks 6. Fixed to upper cross head 134 is a downwardly opening larger hydraulic cylinder 138 and an upwardly opening smaller hydraulic cylinder 140. Lower cross head 136 carries a corresponding upwardly opening larger cylinder 142 and downwardly opening smaller cylinder 144. A piston 146 operable in cylinder 138 has a cross head 148 affixed to its downwardly extended end, and a piston 150 operatively mounted in cylinder 140 has a crosshead 152 rigidly affixed to its upwardly extended end. Cross heads 148 and 152 are rigidly interconnected by a pair of slide rods 154 spaced oppositely from the cylinder axis and movable slidably in cross head 134. Similarly, lower cylinders 142 and 144 are provided with pistons 156 and 158, cross heads 160 and 162, and slide rods 164 movable in cross head 136. Cylinders 138 and 140 thus in effect constitute a single double-acting hydraulic cylinder, as do cylinders 142 and 144. Lower cross head 148 of the upper cylinders carries a female die 166, normally spaced above pipe 32, and adapted to cooperate with male die tooth 110 as will appear. Upper cross head 160 of the lower cylinders carries a back-up support member 168 normally spaced below pipe 32. Die and support members 166 and 168 move respectively downwardly and upwardly when a greater hydraulic pressure is supplied to cylinders 138 and 142, through their ports 170 and 172, than is supplied to cylinders 140 and 144 through their ports 174 and 176, and their motion is reversed when the pressure values are reversed.

Thus, in the punching of a single perforation, greater pressure is supplied to cylinders 138 and 142, and to the lower port 102 of cylinder 98, than is supplied to cylinders 140 and 144 and upper port 106 of cylinder 98. Thus female die 166 is moved downwardly against the external surface of the pipe, male die tooth 110 is moved upwardly to cut a perforation in the pipe wall in cooperation with the female die, and support member 168 is moved upwardly to engage and support the pipe against the reactive downward force exerted by cylinder 98, the lower end of which is configurated to engage the interior surface of the pipe, all as shown in FIG. 4. When the pressure balance is reversed, and a higher pressure is applied to cylinders 140 and 144 and to upper port 106 of cylinder 98, the die and support members are all retracted from the pipe to permit longitudinal or rotary movement of the pipe to position it for the next perforation. The withdrawal of male die finger 110 is facilitated by stripper plate 114, which is configurated to engage the interior surface of the pipe to balance the force of the withdrawal.

The particular form of the perforation produced by dies 110–116 constitutes the formation of a pair of parallel longitudinal slits in the pipe wall, and the outward offsetting of the major portion of the length of the band 178 of metal between said slits by a distance somewhat greater that the wall thickness of the pipe. This opens slots 180 at each side of each band 178, through which water may enter the pipe in its usage as well casing. This form of perforation is often desired since it provides a relatively large area of water flow passages to the pipe interior in proportion to the pipe area, while at the same time keeping the individual slots 180 sufficiently narrow to prevent the entry of any large amount of sand or other foreign matter into the pipe. However, the particular form of perforation formed by dies 110–166 is largely not pertinent to the present invention, except for the cut-off switch to be described, for which other cut-off means could be substituted.

It will be understood that in the operation of the machine, which will later be described in greater detail, pipe 32 advances axially in a forward direction, or to the left as shown in FIG. 1 and 2, in a series of discrete steps, the dies being actuated at each step to punch a perforation in the pipe wall. After the completion of a full longitudinal row of perforations the pipe is returned rearwardly, or to the right as viewed in FIGS. 1 and 2, turned counter-clockwise, facing forwardly, on its axis by indexing head 36 to bring the next longitudinal line of the pipe along which perforations are to be formed into angular alignment with the dies, and then again advanced in steps to form the next line of perforations. This process is repeated until all of the desired rows of perforations have been completed, at which time the machine should be stopped to permit removal of the perforated pipe and the insertion of another unperforated pipe. For this purpose, there is utilized a normally closed electric cut-off switch 182 (see FIGS. 1 and 12) mounted on head plate 4 by bracket 184, being angularly offset from the vertical plane of the dies, in a clockwise direction, by an angle equal to the angle between successive rows of perforations, said switch being opened only so long as its operating button 186 is depressed. Said operating button is disposed radially outwardly from the pipe, so that the smooth pipe wall may pass without engaging it, as shown in FIG. 12. However, as the last row of perforations is completed, the row of perforations of the first row will be in angular alignment with switch 182, and the outwardly offset pipe wall at the perforation which was first formed in said first row will engage and depress the operating button 186 of said switch. Switch 182 forms an element of the control system, which will now be described in detail.

The control system is diagrammed schematically in FIG. 13. Hydraulic fluid is delivered from a reservoir 188 by a hydraulic pump 190 driven by an electric motor 192. Said pump is of a constant pressure-variable delivery type, and delivers fluid through conduit 194 to the input port 196 of a control valve 198, said valve also having a return port 200 connected to reservoir 188 by conduit 202. Said valve has a pair of outlet ports 204 and 206 connected respectively to the opposite ends of a hydraulic booster cylinder 208 by conduits 210 and 212. Operable in cylinder 208 is a piston 214 connected by piston rod 216 to a piston 218 operable in a section 220 of cylinder 208 of smaller diameter, whereby pressure in hydraulic fluid in cylinder 220 below piston 218 is greater than the pressure in cylinder 208 above piston 214. Fluid is supplied to the lower end of cylinder 220 by gravity directly from reservoir 188, through a conduit 222 in which is interposed a check valve 224 operable to permit fluid flow to the cylinder, but not a reverse flow. An outlet port 226 at the lower end of cylinder 220 is connected by a branched conduit 228 to die cylinders 138 and 142, and to lower port 102 of cylinder 98. Cylinders 140 and 144, and also upper port 106 of cylinder 98, are connected by a branched conduit 230 into pump delivery conduit 194 ahead of control valve 198, so that so long as pump 190 is operating, the dies 110 and 166, and also back-up support 168, are hydraulically biased to their retracted positions. High pressure conduit 228 is connected by conduit 232 to the inlet port 234 of a dump valve 236, the outlet port 238 of which is connected to reservoir 188 by conduit 240.

Control valve 198 and dump valve 236 are solenoid-operated, valve 198 having a spindle biased by the energization of solenoid 242 to a "punch" position in which inlet port 196 thereof is connected to port 204 and port 206 is connected to return port 200, and biased by the energization of solenoid 244 to a "retract" position in which inlet port 196 is connected to port 206 and port 204 is connected to return port 200. Dump valve 236 has a spindle biased by the energization of solenoid 246 to a position in which the valve is closed, and biased by the energization of solenoid 248 to a position in which the valve is open. As will appear, all of solenoids 242, 244, 246 and 248 are normally energized, but each valve will then remain in whichever position it then occupies, since the solenoid biasing it toward that position will then dominate the opposing solenoid by reason of the inclusion of a greater proportion of the armature of that solenoid in the solenoid coil. Each valve is shifted to its other position by momentary de-energization of the dominant solenoid.

Shaft 30 of sprocket wheel 24 is driven, in a direction to cause rearward or return travel of carriage 10, by an electric motor 250, which operates through a geared speed reducer 252 and a belt-and-pulley drive 254 to turn an intermediate shaft 256 which is coaxially aligned with shaft 30 and connected thereto through an electric clutch 258 which is engaged only when electric current is supplied thereto. When said clutch is disengaged, shaft 30 is completely disconnected from motor 250.

Shaft 30 is turned in a direction to cause a stepped advancing of carriage 10, by a ratchet wheel 260 fixed on said shaft and driven by a pawl 262 pivoted at 264 to a piston rod 266 affixed to the piston 268 of a small hydraulic step cylinder 270. Said piston is advanced by hydraulic fluid supplied to the cylinder from the pressure outlet port 206 of control valve 198 by conduit 272, and returned by a spring 274. Each forward stroke of piston 268 advances carriage 10 by a distance equal to the desired longitudinal spacing of successive perforations in the pipe. As piston 268 completes its operative stroke, a finger 276 also mounted on piston rod 266 engages the operating button 278 of a normally closed electric switch 280, causing said switch to open. It remains open only so long as the button is depressed. Pawl 262 may be disengaged from ratchet 260 by a lever 282 pivoted at one end to a fixed support, as at 284, and having its opposite end connected to the movable armature of a solenoid 286. Whenever the coil of said solenoid is energized, lever 282 is pivoted upwardly, and it engages a pin 288 affixed to the pawl to disengage it from the ratchet. When the pawl is so disengaged, any free rotation or "coasting" of sprocket 260 is prevented by a friction brake 290 yieldably resisting rotation thereof. Said brake does, however, permit rotation of the ratchet by pawl 262. Whenever solenoid 286 is energized, its armature engages the operating button 292 of a normally closed electric switch 294 to open said switch, the switch remaining open only so long as its button 292 is depressed.

Electric power for the various electrically operated control devices is supplied by a pair of line wires 296 and 298. A starting circuit extends from wire 296 through wires 300 and 302, a normally open push button switch 304, wire 306, the coil 308 of a normally open relay 310, and wire 312 to wire 298. Thus coil 308 is energized whenever push button 304 is momentarily depressed, and relay 310 closes. The closure of this relay establishes a motor circuit from wire 296 through wires 300 and 314, relay 310, wires 316 and 318, pump motor 192 and wire 320 to wire 298, setting the motor and pump 190 in operation, and also establishes a holding circuit for relay coil 308 through wire 316, normally closed shut-off switch 182, wires 322 and 306, coil 308 and wire 312 to wire 298, so that relay 310 remains closed, and motor 192 in operation, until switch 182 is opened, which as previously described occurs only when all of the pipe perforations have been completed, the opening of switch 182 interrupting the holding circuit just described to allow relay 310 to open to interrupt the motor circuit, which then remains open until push button 304 is again depressed.

A circuit which may be called the "punch" circuit extends from wire 296 through wire 324, normally closed "punch" switch 280, wire 326, normally closed switch 294, wire 328, solenoids 244 and 248, which are connected in parallel, and wire 330 to wire 298. A "retract" circuit extends from wire 296 through wire 322, normally closed switch 126 which is operated by lever 118, wire 324, solenoids 242 and 246, which are connected in parallel, and wire 336 to wire 298. Thus all of solenoids 242, 244, 246 and 248 are normally energized, solenoids 244 and 248 being de-energized only by the opening of switches 280 or 294, and solenoids 242 and 246 being de-energized only by the opening of switch 126.

Carriage drive motor 250 is provided with an operating circuit extending from wire 296 through wires 338 and 340, normally open relay 342, wires 344 and 346, motor 250 and wire 348 to wire 296. Thus motor 250 operates only when relay 342 is closed. Relay 342 is closed by the energization of its coil 350 by a circuit extending from wire 296 through wires 338 and 352, normally open front limit switch 88, wire 354, coil 350 and wire 356 to wire 298. Switch 88 is of course closed only as carriage 10 reaches the forward limit of its travel. The closure of relay 342 completes the circuit of motor 250, already traced, and also completes a circuit to electric clutch 258 to cause its engagement, said clutch being connected in parallel with said motor by wires 358 and 360. In addition, the closure of relay 342 completes a circuit from said relay through wires 344 and 362, the coil of solenoid 286 and wire 364 to wire 298, whereby solenoid 286 disengages pawl 262 from ratchet 260, and also completes a holding circuit for relay coil 350 from said relay through wire 344, normally closed rear limit switch 84, and wires 366 and 354, coil 350 and wire 356 to wire 298.

In a complete cycle of operation of the machine, carriage 10 starts at its rearmost position. In this position, as will appear, all of the various electric switches are in their normally open or closed positions except normally closed rear limit switch 84, which is opened by finger 82 of the carriage by virtue of the presence of the carriage in its rearmost position, relays 310 and 342 are both open so that neither pump motor 192 nor carriage drive motor 250 are in operation, and solenoid coil 286 is deenergized so that pawl 262 rests in engagement with ratchet 260. A pipe 32 may then be mounted in the machine by resting its forward end portion rotatably in carriage rollers 34, and mounting its rearward end in clamp ring 58, as already described.

The machine is then started by momentarily depressing push button 304. This energizes relay coil 308 to close relay 310, which completes the previously traced operating circuit of pump motor 192, setting pump 190 in operation, and also the previously described holding circuit for relay coil 308, through shut-off switch 182, so that the pump remains in operation when push button 304 is released. Pump 190 thus delivers fluid through conduit 194 to control valve 198 (then in its die-retracting position, opposite to the position illustrated in FIG. 13), which delivers fluid both to booster cylinder 208 through conduit 212, and to step cylinder 270 through conduit 272. The delivery of fluid to booster cylinder 208 has an effect to be more fully discussed below, while delivery of fluid to cylinder 270 advances piston 268 thereof to cause pawl 262 to advance ratchet wheel 260 to advance carriage 10 forwardly by a distance equal to the desired longitudinal spacing between successive perforations of the pipe. As this carriage advance (about 3 inches in the arrangement shown) is completed, finger 276 engages operating button 278 of switch 280 to open said switch. This interrupts the normally closed circuits of solenoids 244 and 248, the de-energization of these solenoids causing control valve 198 and dump valve 236 to be moved to their "punch" positions (illustrated in FIG. 13) by solenoids 242 and 246, which are energized at this time. The dump valve 236 is thus closed, and control valve 198 is positioned to deliver fluid from its port 204 through conduit 210 to booster cylinder 208 above piston 214, while cylinder 208 below piston 214 is vented back to reservoir 188 through conduit 212, valve 198 and conduit 202. Step cylinder 270 is also vented through conduit 272 at this time, so that its piston 268 and pawl 262 is returned by spring 274. This allows switch 280 to close, but vales 198 and 236 remain in their punch position since solenoids 242 and 246 then dominate solenoids 244 and 248.

As piston 214 of booster cylinder 208 advances downwardly, it drives the smaller piston 218 of cylinder 220, causing it to deliver fluid at an increased pressure to branched conduit 228, both dump valve 236 and check valve 224 being closed. Conduit 228 delivers high pressure fluid to the lower port 102 of cylinder 98 through conduit 104 to advance male die 110 upwardly against the inner surface of pipe 32, to cylinder 138 to advance female die 166 downwardly against the exterior surface of the pipe, and to cylinder 142 to advance back-up support 168 upwardly against the exterior surface of the pipe. This is the punching stroke of the dies, and the die members are extended as described despite the retracting pressure exerted simultaniously by cylinders 140 and 144 and at the upper end of cylinder 98, since the punch pressure is greater than the retracting pressure, and also since the areas of the various die pistons effective in the punching strokes are greater than the areas of the pistons effective during the retracting strokes. Dies 110 - 166 thus advance until one punching stroke has been completed, as shown in FIG. 5, at which time finger 124 of feeler lever 118 engages and depresses control button 128 of switch 126, causing said switch to open.

The opening of switch 126 interrupts the circuits of solenoids 242 and 246, the de-energization of these solenoids allowing valves 198 and 236 to be returned to their "retract" positions by solenoids 244 and 248, which are energized at this time, whereupon fluid at pump pressure is delivered through conduits 230 and 108 to cylinders 140 and 144, and to the upper end of cylinder 98, to cause retraction of die members 110, 166, and 168 out of engagement with the pipe while fluid from the lower end of cylinder 98 is exhausted through conduits 104 and 232, dump valve 236 and conduit 240 to reservoir 188. Pistons 218 and 214 are returned upwardly by fluid entering lower end of cylinder 208 from conduit 212 (then supplied with pump pressure), while fluid above piston 214 is exhausted to the reservoir through conduit 210, ports 204, and 200 of control valve 198, and conduit 202. The movement of the control valve to its "retract" position also connects step cylinder 270 to pump pressure through conduit 272, so that piston 268 advances against spring 274 to cause pawl 262 to turn ratchet wheel 260 to advance carriage 10 and pipe 32 to position for the next punching operation. However, the retracting action of the die pistons is extremely rapid, and there is sufficient play in the engagement of pawl 262 and ratchet 260 that the retraction of the dies is completed before advancement of the carriage is started. The carriage of course cannot be advanced with the dies still in engagement with the pipe. Any fluid lost from the hydraulic system below piston 218, for example through the dump valve 236, is replaced by gravity from reservoir 188 through conduit 222 and check valve 224.

Thus the cycle of advancement of the dies, retraction of the dies and advancement of the carriage is repeated continuously until the carriage has moved forwardly through its entire travel, forming a series of perforations in the pipe wall as indicated in FIG. 5. The first stroke, or perhaps more, of the dies may not form perforations in the pipe, depending on the original spacing of the forward end of the pipe behind the punch axis, as shown in FIG. 1, but the pipe will eventually come into the line of action of the dies. This spacing is of course determined by the placement of rear limit switch 84, which is preferably so placed that the first perforation actually cut does not "bridge" the front end of the pipe.

When the pipe has moved forwardly through its full travel to complete a line of perforations, after the final perforation has been completed and the dies retracted, and after piston 268 of step cylinder 270 has started its forward stroke but before the finger 276 thereof has opened switch 280, so that control valve 198 and dump valve 236 are still in their "retract" positions, carriage finger 86 engages the control button 92 of normally open front limit switch 88. The closure of this switch completes the previously described circuit of coil 350 of normally open relay 342, to close said relay. The closure of relay 342 completes the circuit of the coil of solenoid 286, which disengages pawl 262 from ratchet 260, and opens normally closed switch 294. This opens the "punch" circuit of switch 280 of step cylinder 270, so that all punching action of the dies is suspended with the dies in their retracted positions. The closure of relay 342 also completes the circuit of carriage motor 250, whereby said motor is energized, and of electric clutch 258 to engage said clutch, whereby the motor drives shaft 30 to move carriage 10 in a rearward direction, and also completes a holding circuit for relay coil 350 through rear limit switch 84, so that motor 250 remains in operation, moving the carriage rearwardly, as long as switch 84 remains closed.

As the carriage approaches the rearward limit of its travel, the roller 74 of its indexing head 36 engages ramp 76 of the track and is deflected thereby to turn the pipe about its axis to align the longitudinal line thereof along which it is desired to form the next row of perforations with the dies, as previously described, roller 74 dropping behind the ramp as shown in FIG. 11 when the carriage is at the extreme rearward limit of its travel. At this limit of travel, carriage finger 82 engages operating button 90 of switch 84 to open said switch. This interrupts the holding circuit of relay coil 350, allowing relay 342 to open. The opening of the relay de-energizes carriage motor 250, disengages clutch 258, reengages pawl 262 with ratchet 260, and closes switch 294 of the punch circuit. Closure of switch 294 re-establishes the repetitive die-extension, die-retraction, and pipe advancing cycle already described so that the next row of perforations are formed, the carriage then again being returned rearwardly, with the dies retracted and inoperative, by closure of front limit switch 88, and so on till the desired number of rows of perforations (14 rows as shown), have been completed.

As the last row of perforations are formed and the carriage approaches the forward limit of its travel, the portion of the pipe wall which was offset outwardly in the formation of the first perforation of the first row of perforations approaches and depresses the operating button 186 of shut off switch 182, whereby to open said switch. This interrupts the holding circuit of coil 308 of relay 310, allowing said relay to open. This interrupts the operating circuit of pump motor 192, thus deactivating pump 190 until push button 304 is again manually depressed. The arrival of the carriage at its forward limit also closes front limit switch 88, so that the carriage is again moved to the rearward limit of its travel by motor 250, but when it arrives at its rearward limit and opens rear limit switch 84, the punch-retract-pipe advance cycle cannot start due to lack of operating hydraulic pressure, and the entire system comes to rest. With the fully perforated pipe in this position, it may be removed simply by releasing it from clamp ring 58 and lifting it free of carriage rollers 34, and a new pipe inserted.

Thus it will be apparent that a pipe perforating machine having several advantages has been produced. All punching operations are hydraulically powered, hydraulic power devices lending themselves well to automatic contrls and the relatively small prime-mover power requirements of motor drives for hydraulic pumps. Once initiated by pressing a push button, its operation is entirely automatic, punching any desired number of longitudinal rows of perforations in the pipe substantially without attention by the operator, the perforated pipe being brought to rest at a position in which it may easily be removed from the machine and replaced with another pipe. It is capable of very high-speed operation, which is of course essential to economy of production. While it involves the use of a die internal to the pipe and carried by a cantilevered arbor beam, the beam is not required to support the punching force of the dies, and therefore may be of any length required for pipes of substantial length.

While we have shown and described a specific embodiment of our invention, it will be readily apparent that many minor changes of structure and operation could be made without departing from the spirit of the invention. For example, if the perforation desired does not involve the outward offsetting of a portion of the pipe wall, which as described above operates shut-off switch 182, but should for example consist of a plain hole punched in the pipe, then a switch 182 having a "feeler" capable of dropping into said plain hole could be substituted for that shown. Also, it is quite possible, with larger pipes, to use a plurality of angularly spaced internal dies 110 mounted on arbor beam 94, with a corresponding number of external cooperating dies 166 (and back-up supports 168 if necessary) mounted externally of the pipe, so that a plurality of rows of perforations could be formed simultaneously, for still greater speed and capacity of production. The limiting factor in this respect is of course the size of the pipe itself, larger pipes having sufficient internal area to accomodate the hydraulic gear for operating the internal dies. If a plurality of die sets are used in this manner, they would ordinarily be even in number and arranged in diametrically opposite pairs, so that each die set would serve as the back-up support for the diametrically opposite pair.

What we claim as new and desire to protect by Letters Patent is:

1. A pipe perforating machine comprising:

a. a frame operable to support a pipe in a stationary position, b. cooperating die members carried by said frame and including a male die supported by said frame for movement in a straight line radial to said pipe, said male die having a pair of generally parallel, closely spaced apart cutting edges of a length at least several times the lateral spacing therebetween, the central portions of said cutting edges extending generally at right angles to the radial movement of said die, and the end portions thereof being inclined obtusely away from a plane established by the central portions of said cutting edges, and away from the confronting wall surface of said pipe, to a radial distance from said plane greater than the wall thickness of said pipe, and c. power means operable to move said male die radially of said pipe to engage a wall of said pipe and to form a perforation in said wall, the radial movement of said die, after it initially engages said pipe wall, being greater than the wall thickness of said pipe, but less than the radial spacing between the central portions and the extreme ends of said die cutting edges, whereby the central portion of the strip of pipe wall between said die cutting edges is offset laterally from the pipe wall by a distance greater than the wall thickness, and the ends of said pipe wall strip are left connected to the standing portion of the pipe wall.

2. A pipe perforating machine comprising:

a. a frame, b. a cantilevered arbor beam fixed in said frame, c. tracks carried fixedly by said frame in parallel relation to said arbor beam, d. a carriage movable along said tracks, e. means operable to support a pipe to be perforated on said carriage in parallel relation to said arbor beam and coaxially therewith, whereby said pipe may be moved coaxially over the free end of said beam, f. cooperating die members carried by said frame and including an internal die carried movably by said arbor beam at the free end thereof for extension radially of said beam to engage said pipe and form a perforation in the wall thereof, said pipe being movable axially over said internal die when the latter is retracted; an external die carried movably by said frame externally of said pipe for movement coaxial to the extend-retract movement of said internal die, being inwardly extendable radially of said pipe to cooperate with said internal die in forming said perforation, and radially outwardly retractable to disengage said pipe; and a back-up support member carried by said frame externally of said pipe for movement radially of said pipe in diametrically opposite relation to said external die, being extendable to engage said pipe and retractable to disengage said pipe, said arbor beam carrying a rigid member operable on very slight deflection of said beam to engage the interior wall of said pipe opposite from said internal die, and g. a control system operable to extend and retract said internal and external dies, and said back-up support member simultaneously, said control system including a double-acting hydraulic cylinder for operating each of said internal and external dies, and said back-up support, the pistons of said cylinders being operable by movement thereof in one direction to extend said dies, and said back-up support member, and by movement thereof in the opposite direction to retract said dies, and said back-up support member, means operable to deliver hydraulic fluid at a constant pressure to the die-retraction sides of the pistons of said double-acting hydraulic cylinders, whereby said dies, and said back-up support member, are biased toward their retracted positions, and means operable alternately to deliver hydraulic fluid at a still higher pressure to the die-extension sides of the pistons of said double-acting cylinders, whereby said dies, and said back-up support member are moved to their extended positions, and to exhaust said higher pressure fluid.

3. A pipe perforating machine comprising:

a. a frame, b. a cantilevered arbor beam fixed in said frame, c. tracks carried fixedly by said frame in parallel relation to said arbor beam, d. a carriage movable along said tracks, e. means operable to support a pipe to be perforated on said carriage in parallel relation to said arbor beam and coaxially therewith, whereby said pipe may be moved coaxially over the free end of said beam, f. cooperating die members carried by said frame and including an internal die carried movably by said arbor beam at the free end thereof for extension radially of said beam to engage said pipe and form a perforation in the wall thereof, said pipe being axially movable over said internal die when the latter is retracted, and g. a control system operable to extend and retract said internal die alternately, as said pipe is moved axially over said arbor beam, whereby a series of perforations are formed in the wall of said pipe, said control system comprising die-extending means operable when actuated to extend said cooperating die members to form a perforation in the wall of said pipe, die-retracting means operable when actuated to retract said die members out of engagement with said pipe, pipe advancing means operable each time it is actuated to advance said carriage and pipe axially by a distance equal to the desired longitudinal spacing between successive perforations in said pipe, a first limit switch operable by extension of said cooperating die members to their fully extended positions, at which time a perforation is completed, to deactivate said die-extending means and to actuate said pipe advancing means, and a second limit switch operable by the completion of the operation of said pipe advancing means to advance the pipe by the desired distance, to deactivate said die-retraction means and said pipe advancing means, and to actuate said die-extension means, whereby the functions of die-extension, die-retraction, and advancing of the pipe are accomplished in a continuously repetitive cycle.

4. A pipe perforating machine as recited in claim 3 wherein said die-extending means and said die-retracting means for each of said cooperating die members constitutes:

a. a double-acting hydraulic cylinder the piston of which is movable in one direction to extend said die member, and in the opposite direction to retract said die member, b. means operable to supply a continuous lower hydraulic pressure to the die-retraction side of said piston, c. means controlled by said second limit switch to supply a higher hydraulic pressure to the die-extension side of said piston, and d. means controlled by said first limit switch to exhaust said higher hydraulic pressure from the die-extension side of said piston.

5. A pipe perforating machine as recited in claim 4 wherein the die-extension side of said piston is of greater effective area than the die-retraction side thereof.

6. A pipe perforating machine as recited in claim 3 wherein said control system additionally includes:

a. pipe return means operable when actuated to move said carriage and pipe continuously in a direction opposite to that in which it is moved by said pipe advancing means, b. a third limit switch operable by the arrival of said carriage at the advancing limit of its travel, at which time a full longitudinal row of perforations in said pipe will have been completed, to deactuate side die-extension means, whereby said die members remain in their retracted positions, to deactuate said pipe advancing means, and to actuate said pipe return means, whereby said pipe is returned to its starting position, and c. a fourth limit switch operable by arrival of said carriage at its return limit to deactuate said pipe return means.

7. A pipe perforating machine as recited in claim 6 wherein said pipe is supported on said carriage by means permitting rotation of said pipe about its axis, whereby it may be turned angularly to position another longitudinal line thereof in alignment with said die members, when it is in its return limit position.

8. A pipe perforating machine as recited in claim 7 with the addition of pipe indexing means operable automatically to turn said pipe about its axis by an angular distance equal to the desired angular spacing between successive longitudinal rows of perforations to be formed in said pipe, during the return movement of said carriage.

9. A pipe perforating machine as recited in claim 7 with the addition of:

a. an indexing head mounted on said carriage for rotation on an axis coaxial with said pipe, b. clamp means operable to clamp said pipe to said head coaxially therewith, said indexing head having an operating member operable when deflected to turn said head rotatably by an angle equal to the desired angular spacing between successive longitudinal rows of perforations to be formed in said pipe, and c. an operator for said head consisting of a member mounted on said track and operable during the return movement of said carriage to engage and deflect the operating member of said indexing head.

10. A pipe perforating machine as recited in claim 8 wherein said fourth limit switch is operable by the arrival of said carriage at its return limit to reactuate said die-extending means and said pipe advancing means, in addition to deactuating said pipe return means, whereby successive rows of perforations are formed automatically until the pipe is completely perforated.

11. A pipe perforating machine as recited in claim 10 with the addition of a fifth limit switch operable to engage and be actuated by the first perforation of the first row of perforations formed, as the last perforation of the last row of perforations formed is completed, actuation of said fifth limit switch functioning to deactuate said die-extending means by means independent of said first and third limit switches, but not said pipe return means, whereby the machine comes to rest after the next return travel of the carriage has been completed.

12. A pipe perforating machine as recited in claim 11 with the addition of:

a. manually operable means for reactuating said die-extending means whenever the latter has been deactuated by actuation of said fifth limit switch.

* * * * *